US005445303A

United States Patent [19]

Cawile, Jr.

[11] Patent Number: 5,445,303

[45] Date of Patent: Aug. 29, 1995

[54] MODULAR PACK SYSTEM

[76] Inventor: Sidney C. Cawile, Jr., 25589 Calabria Dr., Moreno Valley, Calif. 92553

[21] Appl. No.: 191,037

[22] Filed: Feb. 3, 1994

[51] Int. Cl.[6] ..... A45F 3/50

[52] U.S. Cl. ..... 224/222; 224/226; 224/253

[58] Field of Search ..... 224/222, 226, 227, 253, 224/252, 224, 234

[56] References Cited

U.S. PATENT DOCUMENTS

| | | | |
|---|---|---|---|
| 633,550 | 9/1899 | Hoffman | 224/222 |
| 1,292,728 | 1/1919 | Dozier | 224/253 |
| 3,322,311 | 5/1967 | Homer | 224/222 |
| 3,389,784 | 6/1968 | Hendricks et al. | 224/253 |
| 4,029,242 | 6/1977 | Stoesser | 224/222 |
| 4,303,187 | 12/1981 | Berman | 224/222 |
| 4,303,239 | 12/1981 | Walsh, Jr. | 224/222 |
| 4,410,118 | 10/1983 | Taurisano | 224/222 |
| 4,763,821 | 8/1988 | Powell | 224/222 |
| 4,852,782 | 8/1989 | Wu et al. | 224/222 |
| 4,953,767 | 9/1990 | Bennett | 224/253 |
| 5,215,238 | 6/1993 | Baruch | 224/253 |

*Primary Examiner*—Henry J. Recla
*Assistant Examiner*—Charles R. Eloshway
*Attorney, Agent, or Firm*—Loyal M. Hanson

[57] ABSTRACT

A leg pack is disclosed that includes a first pack have a size and shape suitable for lying along a leg of a user intermediate the waist and the knee, a waist securing arrangement for securing the first pack to the waist of the user, one or more leg securing straps for securing the first pack to the leg of the user, and auxiliary pack attachment fasteners for removably attaching a second pack to the lower portion of the first pack. Auxiliary packs may be provided for military, recreational, mountaineering, police, and student use.

3 Claims, 4 Drawing Sheets

MODULAR PACK SYSTEM

BACKGROUND OF THE INVENTION

1. Technical Field

This invention relates generally to packs for military, mountaineering, police, recreational, and other uses, and more particularly to a leg pack providing increased functionality, advantageous load-bearing attributes, and convenient modularity.

2. Background Information

Consider the currently popular fanny pack. It includes a small pouch that straps conveniently around the user's waist to rest against the lower back, abdomen, or hip. Constructed in various sizes of nylon fabric with an opening that closes with a zipper or a hook-and-loop fastener, the pouch is suitably sized for carrying a wallet, set of keys, driver's license, currency and so forth. For many uses, it is just more convenient than a conventional back pack.

However, a fanny pack can be uncomfortable in various situations. It can flop around during physical activity and flap annoyingly against the user's body. A heavy load within the pouch makes that tendency all the more undesirable, and carrying a heavy load in a fanny pack strapped around the waist can aggravate a back problem. In addition, the fanny pack can get in the way during some activities and be inconvenient to access when resting against the lower back. These and related problems make a different pack design desirable.

SUMMARY OF THE INVENTION

This invention solves the problems outlined above by providing a pack that straps to the user's leg. Dubbed a leg pack, it is outfitted with one or more belt loops or an attached strap for securing an upper edge of the leg pack at the user's waist somewhat like a fanny pack. But, the leg pack is large enough to lie along the user's hip and it includes one or more leg straps for securing it to the upper leg.

That arrangement inhibits flopping around during physical activity. It also transfers most of the weight to the user's leg, and it enables larger pack sizes with more storage space than a conventional fanny pack. One embodiment includes fasteners along a lower edge to which an auxiliary pack can be fastened. The user chooses any of various auxiliary pack models, attaches it to a lower portion of the leg pack, and straps it to the leg below the knee. Preferably the pack is fabricated of nylon fabric for comfort and ruggedness. Quick-release plastic strap fasteners of the type used in mountaineering equipment add convenience and a high-tech appearance.

In terms of the claim language that is subsequently developed, a pack constructed according to the invention includes a first pack having a size and shape suitable for lying along a leg of a user intermediate the waist and the knee. Waist securing means are provided for securing the first pack to the waist of the user. Leg securing means are also provided for securing the first pack to the leg of the user. In addition, the first pack includes auxiliary pack attachment means for removably attaching a second pack to the lower portion of the first pack.

The foregoing and other objects, features, and advantages of the invention become more apparent upon reading the following detailed description with reference to the illustrative drawings.

DESCRIPTION OF THE PREFERRED EMBODIMENTS

Figure 1:
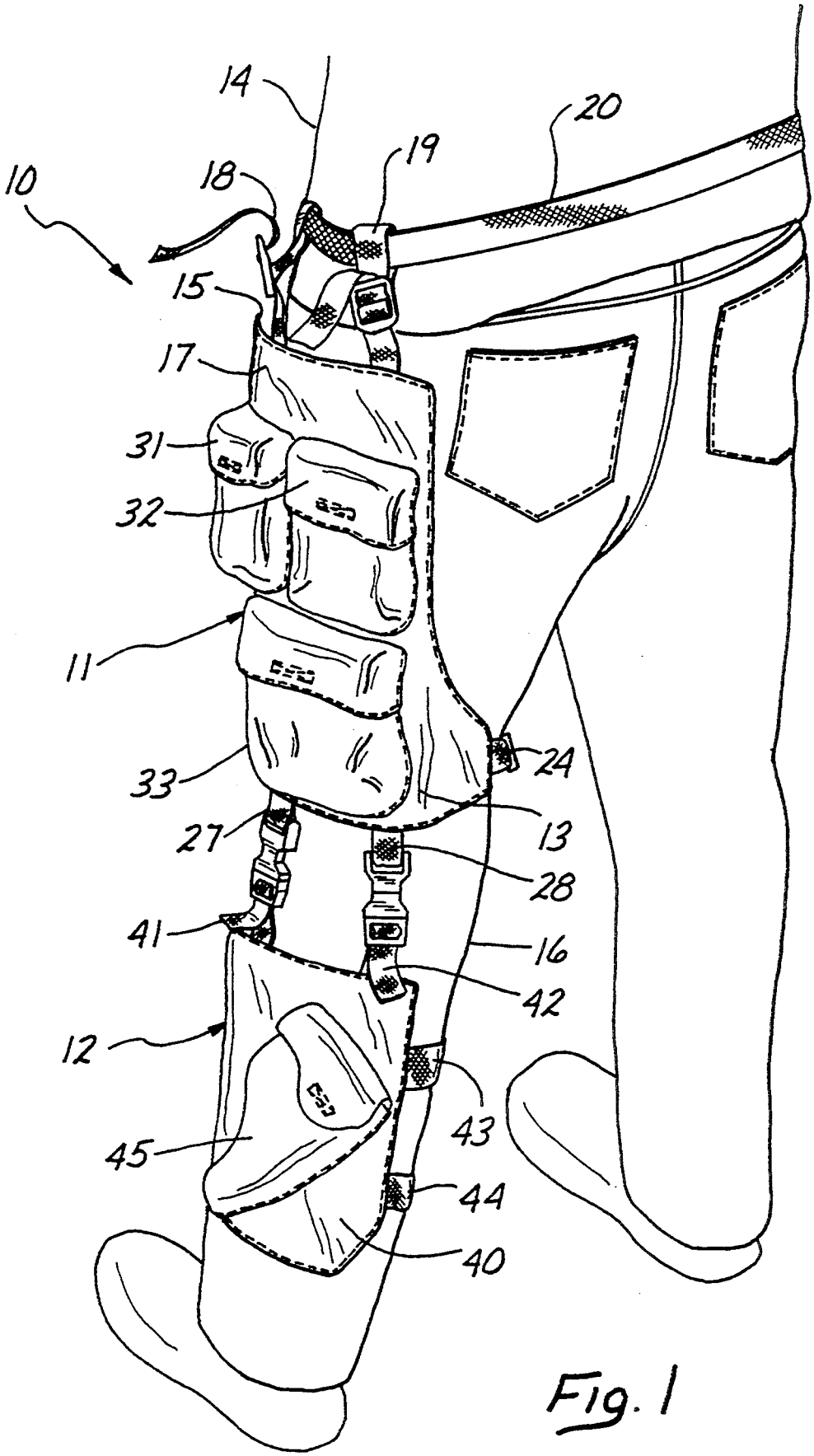
FIG. 1 of the drawings is a pictorial view of a leg pack constructed according to the invention shown secured to a user's body with an auxiliary pack attached.

FIG. 1 of the drawings shows a leg pack 10 constructed according to the invention. It includes an upper or first pack 11 and a lower or second pack 12 attached. to a lower portion 13 of the first pack 11. They secure to the waist and leg of a user 14 as subsequently described.

Figure 2:
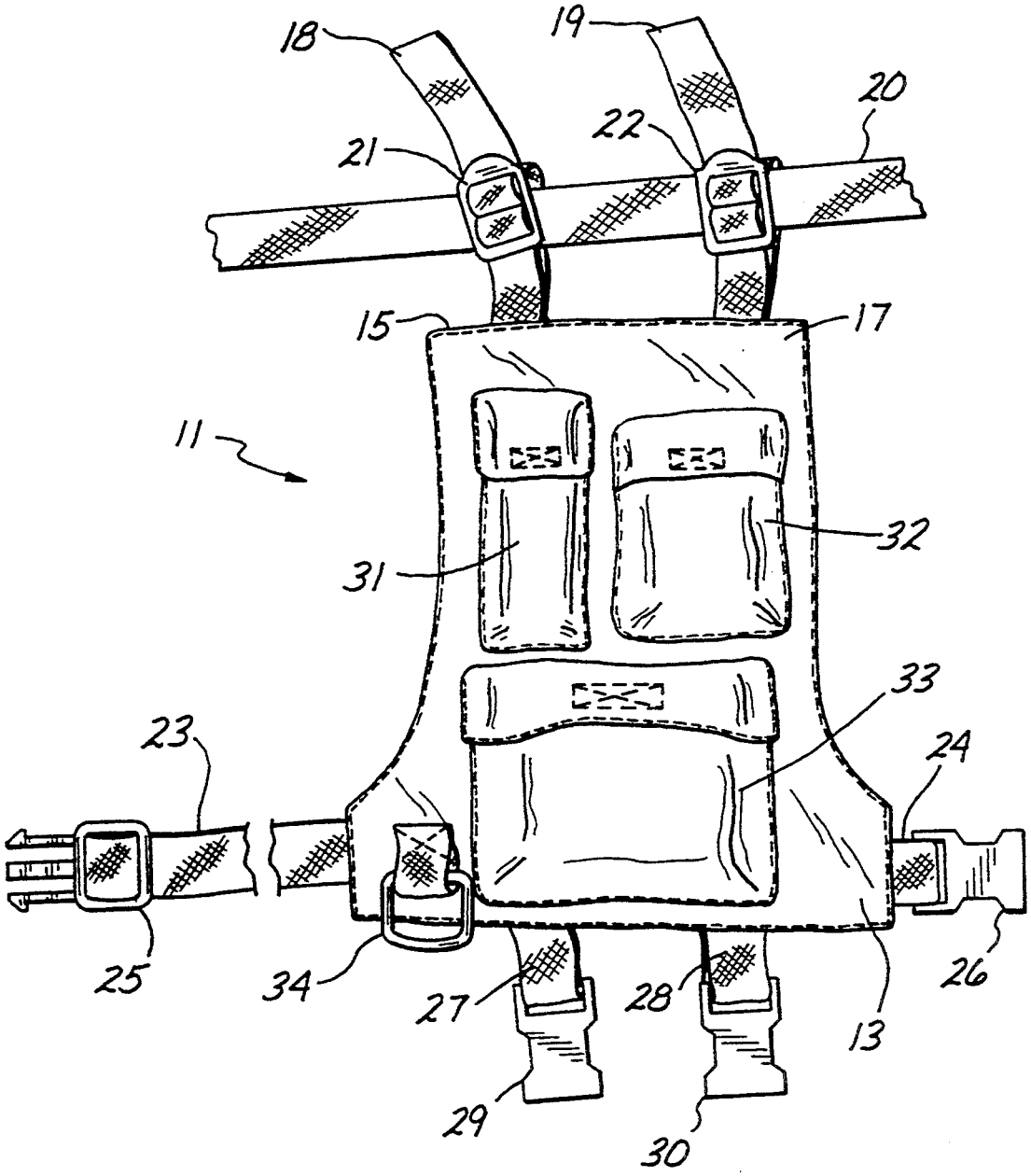
FIG. 2 is an enlarged front view of the leg pack.
Figure 4:
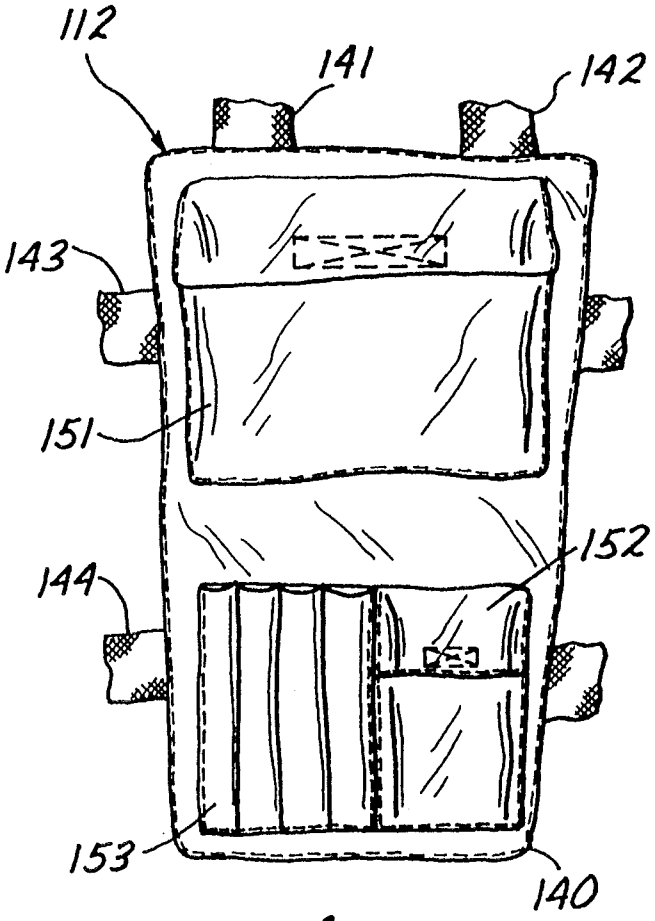
FIG. 4 shows a second auxiliary pack for students.

The first pack 11 includes a panel 15 (FIGS. 1 and 2). It is a double layer of a nylon fabric material sewn together to have a size and shape suitable for lying along the leg 16 of the user 14 as illustrated in FIG. 1, intermediate the waist and knee. Of course, other compositions may be employed within the broader inventive concepts disclosed, but a nylon fabric is a readily available material that exhibits ruggedness and yet conforms comfortable to the user's body.

The panel 15 has a size and shape suitable for lying along the leg 16 of the user 14 as illustrated in the sense that its length measured along the leg 16 does not substantially exceed the distance between the waist and the knee of an average five and one-half to six foot person. Preferably, its length is less than that distance. In addition, the width of the panel 15 measured perpendicular to its length is sufficiently small that it does not extend substantially over the buttock or abdomen of the user 14. Yet, the panel 15 is sufficiently large to provide a first or base component of the first pack 11 to which are attached various pockets in which to pack items. As a further idea of size, the panel 15 has a twelve-inch length, a nine-inch width at an upper portion 17, and an eleven-inch width at the lower portion 13.

Loops 18 and 19 sewn to the upper portion 17 of the panel 15 loop over a strap or belt 20, and the belt 20 is strapped around the user's waist to secure the panel 15 to the user's waist. In other words, the loops 18 and 19 serve as waist securing means for securing the panel 15 (and thereby the first pack 11) to the waist of the user 14. The loops 18 and 19 are fabricated of commercially available nylon strapping and may include conventional keepers 21 and 22 (FIG. 2) for adjustment purposes. Of course, other arrangements may be utilized to secure the panel 15 to the user's waist. For example, a belt may be sewn directly to the panel 15. Alternatively, the upper portion 17 of the panel 15 can be double over against itself to form a belt loop.

Nylon leg strap sections 23 and 24 sewn to the lower portion 13 of the panel 15 include quick-release buckle components 25 and 26 (FIG. 2) of the type used on military and mountaineering equipment (available from ITW Corporation of Wooddale, Ill.). The buckle components 25 and 26 snap together with the strap sections 23 and 24 positioned around the leg 16 of the user 14 as depicted in FIG. 1). That secures the panel 15 to the user's leg, and so the straps sections and buckle components combine as leg securing means for securing the panel 15 (and thereby the first pack 11) to the leg of the user. Additional nylon strap sections 27 and 28 sewn to the lower portion 13 of the panel 15 include female quick-release buckle components 29 and 30. Those strap sections and buckle components combine as auxiliary pack attachment means for removably attaching the second pack 12 to the lower portion 13 of the panel 15.

Pockets 31–33 made of nylon fabric sewn to the panel 15 form compartments in which to pack items. Any of various pocket sizes and arrangements may be provided. They include flaps that close with zippers or with hook-and-loop fasteners of the type sold under the tradename VELCRO. In addition to the pockets, the first pack 11 may include a D-ring 34 attached to the panel 15 so that the user can hook onto it as desired.

Figure 3:
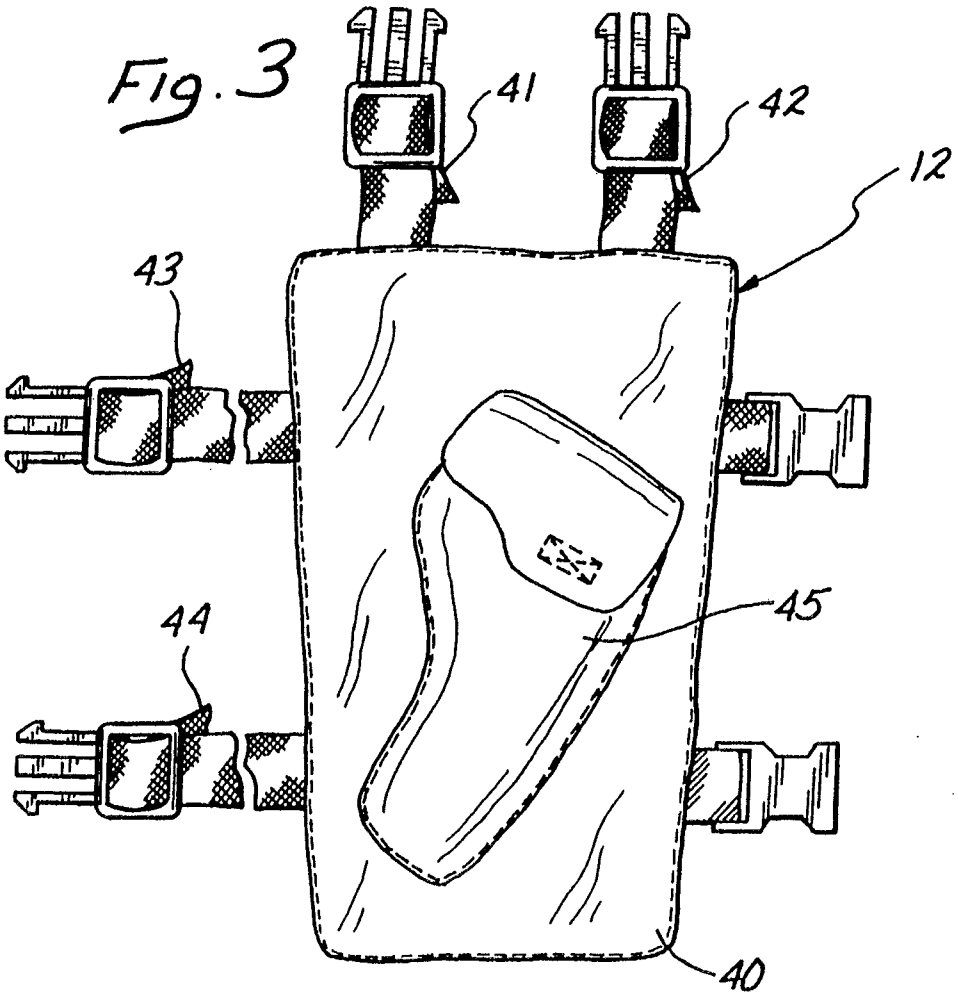
FIG. 3 is an enlarged front view of the auxiliary pack.
Figure 7:
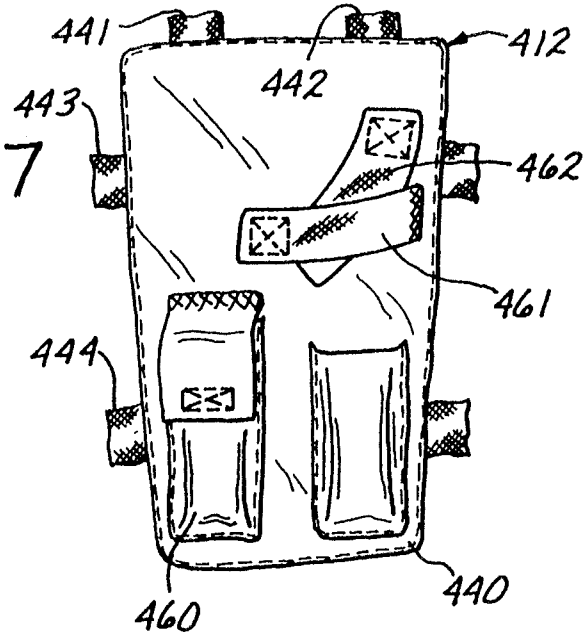
FIG. 7 shows a fifth auxiliary pack for military/S.-W.A.T. team use.
Figure 6:
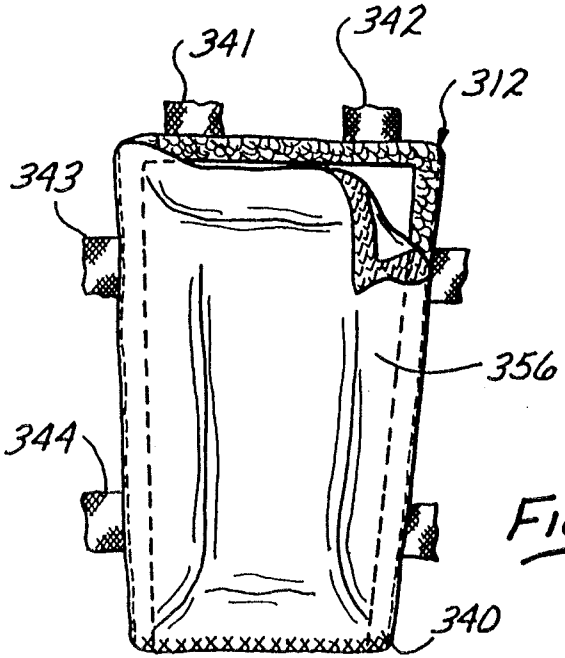
FIG. 6 shows a fourth auxiliary pack that also may be added to any of the other auxiliary packs as an external cover to cover the other components and hold maps, documents, and. other such items.
Figure 5:
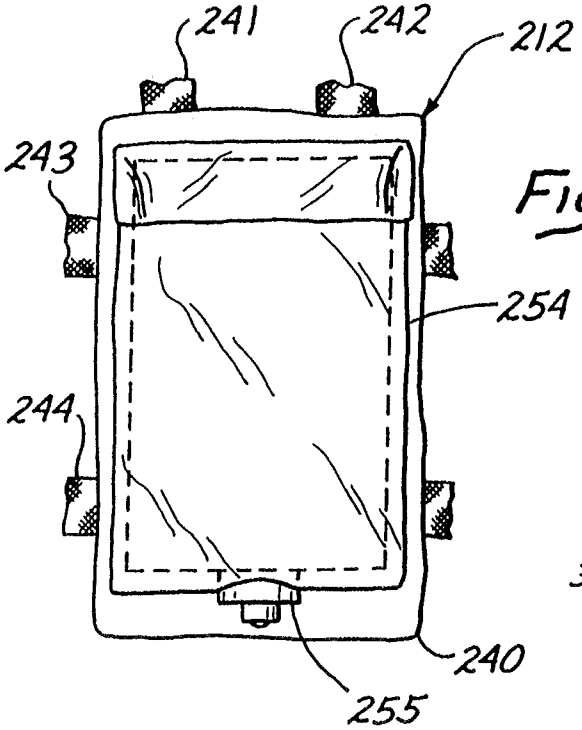
FIG. 5 shows a third auxiliary pack that holds a water bottle.

Now consider the auxiliary second pack 12 (FIGS. 1 and 3). It includes a panel 40 that is a double layer of a nylon fabric material sewn together to have a size and shape suitable for lying along the leg 16 of the user 14 as illustrated in FIG. 1, intermediate the first pack 11 and the ankle. It is so shaped and dimensioned in the sense that its length (measured vertically in FIGS. 1 and 3) not substantially exceed the distance between the knee and ankle of an average five and one-half to six foot person. Preferably, its length is less than that distance. In addition, the width of the panel 15 measured perpendicular to its length is sufficiently small that it does not extend substantially around the leg. Yet, the panel 40 is sufficiently large to provide a first or base component of the second pack 12. As a further idea of size, the panel 40 has an eleven-inch length and a nine-inch width.

Strap-and-buckle combinations 41 and 42 sewn to the panel 40 mate with the female quick-release buckle components 29 and 30 on the first pack 11. The user removably attaches the second pack 12 to the first pack 11 by snapping male quick-release buckle components on the strap-and-buckle combinations 41 and 42 into the female buckle components 29 and 30. Leg straps 43 and 44 sewn to the panel 40 are similar to the nylon leg strap sections 23 and 24 and quick-release buckle components 25 and 26 of the first pack 11. They serve as means attached to the panel 40 for securing the panel 40 to the leg of the user. A holster 45 formed of nylon fabric material sewn to the panel 40 includes a flap that is held closed with VELCRO.

FIGS. 4–7 show various other second pack designs. They are designated as second packs 112, 212, 312, and 412. Each is similar in many respects to the second pack 12 shown in FIG. 3. For convenience, reference numerals designating parts of each of those second packs are increased by a multiple of one hundred over the reference numerals designating corresponding parts of the second pack 12.

The second pack 112 (FIG. 4) is designed for student use. It includes a pocket 151 for a calculator, a pocket 152 for miscellaneous items, and a pencil holder 153. The second pack 212 (FIG. 5) includes a pocket 254 containing a water bladder 255.

The second pack 312 (FIG. 6) includes a one large pocket 356 with a large flap that is sewn at the bottom edge and held closed along the other three edges with VELCRO. The second pack 312 also illustrates a cover that may be included over each of the other second packs 12, 112, 212, and 412 as a third layer for covering the other components of the second packs. The second pack 412 (FIG. 7) includes a clip holder 460 and VELCRO straps 461 and 462 for holding various items.

Thus, the invention provides a leg pack that straps to the user's leg. It inhibits flopping around during physical activity. It transfers most of the weight to the user's leg. It enables larger pack sizes with more storage space than a conventional fanny pack. Fasteners along a lower edge enable the user to attach a selected one of various auxiliary pack models. Nylon fabric provides comfort and ruggedness. Quick-release fasteners add convenience and a high-tech appearance.

Although an exemplary embodiment has been shown and described, one of ordinary skill in the art may make many changes, modifications, and substitutions without necessarily departing from the spirit and scope of the invention.

What is claimed is:

1. A pack, comprising:

a first pack having a size and shape suitable for lying along an outer thigh portion of a leg of a user intermediate a waist of the user and a knee of the leg without extending beyond the knee, the first pack having an upper portion, a lower portion, and means in the form of at least one pocket for holding at least one item;

waist securing means for securing the upper portion of the first pack to the waist of the user;

leg securing means in the form of at least one strap attached to the lower portion of the first pack for securing the lower portion of the first pack to the leg of the user above the knee of the leg;

auxiliary pack attachment means in the form of at least one quick-release buckle component for removably attaching a second pack to the lower portion of the first pack; and at least one second pack having a size and shape suitable for lying along the leg of the user intermediate the knee of the leg of the user and an ankle region of the leg, the second pack having a first edge and means in the form of at least one pocket for holding at least one other item;

the second pack having means in the form of at least one other quick-release buckle component that mates with the quick-release buckle component of the auxiliary pack attachment means on the first pack for removably attaching the second pack to the lower portion of the first pack so that the second pack lies below the lower portion of the first pack and intermediate the knee and the ankle region of the leg; and the second pack having means in the form of at least one strap for securing the second pack to the leg of the user intermediate the knee and the ankle of the leg.

2. A pack as recited in claim 1, wherein the second pack includes at least one element selected from the group consisting of a holster, a calculator holder, a pencil holder, a water bottle holder, an ammunition clip holder, and a map case.

3. A pack as recited in claim 1, wherein the waist securing means includes at least one loop attached to an upper edge of the first pack for receiving a belt.

* * * * *